US007901177B2

(12) United States Patent
Bellows

(10) Patent No.: US 7,901,177 B2
(45) Date of Patent: Mar. 8, 2011

(54) FLUID PUMP HAVING MULTIPLE OUTLETS FOR EXHAUSTING FLUIDS HAVING DIFFERENT FLUID FLOW CHARACTERISTICS

(75) Inventor: James C. Bellows, Maitland, FL (US)

(73) Assignee: Siemens Energy, Inc., Orlando, FL (US)

( * ) Notice: Subject to any disclaimer, the term of this patent is extended or adjusted under 35 U.S.C. 154(b) by 1041 days.

(21) Appl. No.: 11/712,813

(22) Filed: Mar. 1, 2007

(65) Prior Publication Data

US 2008/0213102 A1 Sep. 4, 2008

(51) Int. Cl.
*F01D 3/02* (2006.01)

(52) U.S. Cl. ..... 415/103; 417/251

(58) Field of Classification Search ..... 415/103, 415/199.1, 199.2, 206; 417/248, 251, 252
See application file for complete search history.

(56) References Cited

U.S. PATENT DOCUMENTS

| | | | | | |
|---|---|---|---|---|---|
| 1,158,569 | A | * | 11/1915 | Sebald | 415/99 |
| 1,586,978 | A | * | 6/1926 | Dorer | 415/99 |
| 1,623,082 | A | * | 4/1927 | Ames | 415/99 |
| 2,315,656 | A | * | 4/1943 | Rhoda | 417/81 |
| 2,407,987 | A | * | 9/1946 | Landberg | 415/94 |
| 2,694,365 | A | * | 11/1954 | Armstrong et al. | 417/81 |
| 2,735,367 | A | * | 2/1956 | Kenney | 415/99 |
| 3,229,642 | A | * | 1/1966 | Lobanoff et al. | 415/100 |
| 4,031,372 | A | | 6/1977 | Davis | |
| 4,234,290 | A | | 11/1980 | Lobach et al. | |
| 4,551,796 | A | | 11/1985 | Singh | |
| 4,589,821 | A | | 5/1986 | Rondot et al. | |
| 5,218,843 | A | | 6/1993 | Dao | |
| 5,246,336 | A | * | 9/1993 | Furukawa | 415/98 |
| 5,404,724 | A | | 4/1995 | Silvestri | |
| 5,733,104 | A | | 3/1998 | Conrad et al. | |
| 5,761,896 | A | | 6/1998 | Dowdy et al. | |
| 5,846,052 | A | | 12/1998 | Kameda | |
| 5,873,238 | A | | 2/1999 | Bellows | |
| 6,141,952 | A | | 11/2000 | Bachmann et al. | |
| 6,145,295 | A | | 11/2000 | Donovan et al. | |
| 6,227,802 | B1 | | 5/2001 | Torgerson et al. | |
| 6,398,504 | B1 | | 6/2002 | Arai et al. | |
| 6,464,469 | B1 | * | 10/2002 | Grob et al. | 417/251 |
| 6,494,045 | B2 | | 12/2002 | Rollins | |
| 6,676,368 | B2 | | 1/2004 | Carboneri et al. | |
| 6,735,947 | B1 | | 5/2004 | Dormier et al. | |
| 6,804,964 | B2 | | 10/2004 | Bellows et al. | |
| 7,017,330 | B2 | | 3/2006 | Bellows | |
| 2002/0037215 | A1 | * | 3/2002 | Choi et al. | 415/104 |
| 2003/0072403 | A1 | | 4/2003 | Dagard | |
| 2003/0228213 | A1 | * | 12/2003 | Bikos et al. | 415/101 |

FOREIGN PATENT DOCUMENTS

JP 60-062673 4/1985

* cited by examiner

*Primary Examiner* — Edward Look
*Assistant Examiner* — Sean J Younger

(57) ABSTRACT

A pump configured to receive fluids through an inlet and direct those fluids in two directions through two or more fluid discharge outlets, wherein the fluids are discharged with different fluid characteristics, such as different pressures or flow rates. In one embodiment, the pump may include first and second pumping chambers for pumping fluids from the pump with different pressures or flow rates, or both, eliminating the need for two pumps. The fluid may be exhausted from the pump through a first fluid discharge outlet and a second fluid discharge outlet of the pump.

10 Claims, 2 Drawing Sheets

FLUID PUMP HAVING MULTIPLE OUTLETS FOR EXHAUSTING FLUIDS HAVING DIFFERENT FLUID FLOW CHARACTERISTICS

FIELD OF THE INVENTION

This invention is directed to fluid pumps, and more particularly, to fluid pumps capable of exhausting fluids at different pressures or flow rates, or both.

BACKGROUND OF THE INVENTION

Mechanical systems often include a plurality of pumps for pumping fluids at different flow rates or different pressures, or both. For instance, power generation facilities often have boiler systems that require fluids to be pumped at different flow rates and pressures. These boiler systems move fluids for multiple purposes including heat transfer and steam production. Boiler systems can be incorporated into power generation systems that include combustion turbines, steam turbines or a combination of combustion and steam commonly referred to as combined-cycle generation systems. The boiler systems are critical to the operation of the power generation system. While multiple pumps have proven useful in such mechanical systems, each pump requires space, consumes power and includes a separate drive source. In addition, use of multiple pumps results in an increased chance of pump failure, which increases the likelihood of system downtime and increased expenses. Thus, a need exists for a more efficient system for generating fluid flows having different pressures and different flow rates.

SUMMARY OF THE INVENTION

This invention is directed to a pump configured to receive fluid through an inlet and direct the fluid in two directions-through two or more fluid discharge outlets where the pressures and flows at each outlet are different from those at the other outlets. In one embodiment, the fluid may be exhausted from one end of the pump through a first fluid discharge outlet and from other end of the pump through a second fluid discharge outlet of the pump at a different pressure and flow rate. For instance, in one embodiment, the fluid flowing from the first fluid discharge outlet may be at a first pressure that is greater than a pressure of the fluid exhausted from the second fluid discharge outlet. In other embodiments, other fluid characteristics, such as, but not limited to, flow rate, may be varied as well. In other embodiments, fluid may be taken from each end of the pump and two or more discharge points, each with a different pressure and flow rate. The pump may be used in numerous applications, such as, but not limited to, boiler systems, combustion turbine power generation systems combined-cycle power generation systems and others.

The pump may be configured to discharge fluids through different outlets with different output characteristics. The pump may include a pump housing having a fluid inlet in the pump housing for receiving a fluid for pumping. The pump may also include a first pumping chamber in fluid communication with the single fluid inlet through a first inlet channel and a second pumping chamber in fluid communication with the first fluid inlet through a second inlet channel. A first fluid discharge outlet may be in fluid communication with the first pumping chamber for discharging a fluid, and a second fluid discharge outlet may be in fluid communication with the second pumping chamber for discharging a fluid. The fluid discharged from the first fluid discharge outlet may have different output characteristics than the fluid discharged from the second fluid discharge outlet. The fluid discharged from the first fluid discharge outlet may have a higher pressure than a pressure of the fluid discharged from the second fluid discharge outlet.

The pump may also include a third fluid discharge outlet in which a fluid is discharged at a pressure lower than the pressure fluid discharged from the second fluid discharge outlet, thereby forming a high pressure outlet at the first fluid discharge outlet, an intermediate pressure outlet at the second fluid discharge outlet, and a low pressure extraction at the third fluid discharge outlet. The third fluid discharge outlet may be coupled to the second pumping chamber and positioned between the intermediate pressure outlet and the inlet. In one embodiment, the first pumping chamber and the second pumping chamber may be aligned axially and separated by the fluid inlet. The first pumping chamber may be a first impeller chamber including at least one impeller, and the second pumping chamber may be a second impeller chamber including at least one impeller. The at least one impeller in the first pumping chamber and the at least one impeller in the second chamber may be operatively connected to a shaft that may be coupled to a motor.

An advantage of this invention is that a single pump of the invention configured to generate two separate fluid flows through two outlets, whereby the fluid flows have different pressures or flow rates, or both, may be more cost effective than using two separate pumps to generate two different fluid flows having different pressures or flow rates.

Another advantage of this invention is that the pump may include a first pumping chamber at a first end and a second pumping chamber at a second end that is generally opposite to the first end, thereby forming a double-ended pump in which thrust in the pump is at least partially balanced.

Still another advantage of this invention is that the pump may be able to deliver large intermediate pressure flows while maintaining optimum pump efficiency through the higher pressure sections.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DISCLOSURE OF THE INVENTION

Figure 1:
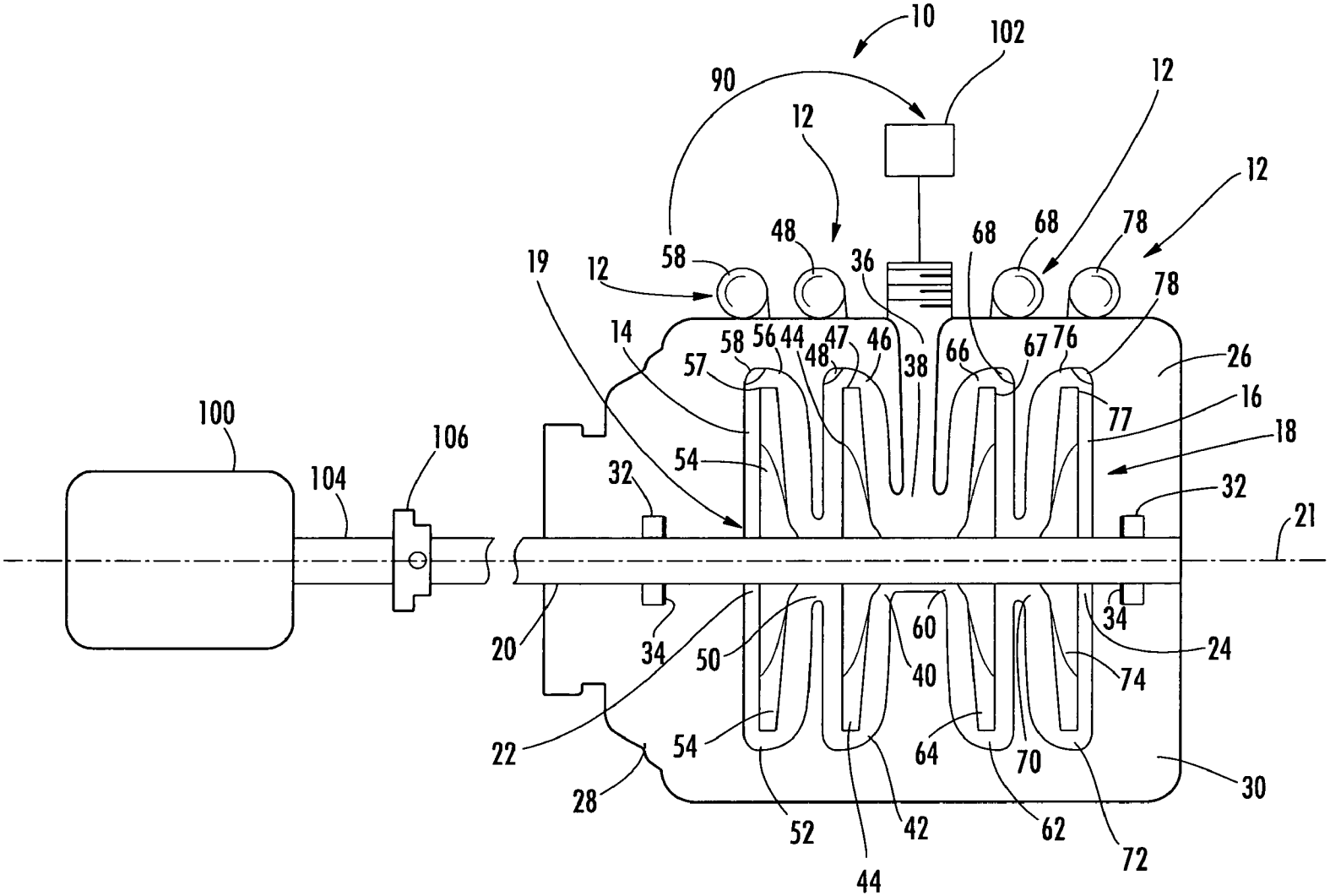
FIG. 1 is a partial cross-sectional schematic view of a fluid pump having multiple outlets according to aspects of the present invention.
Figure 2:
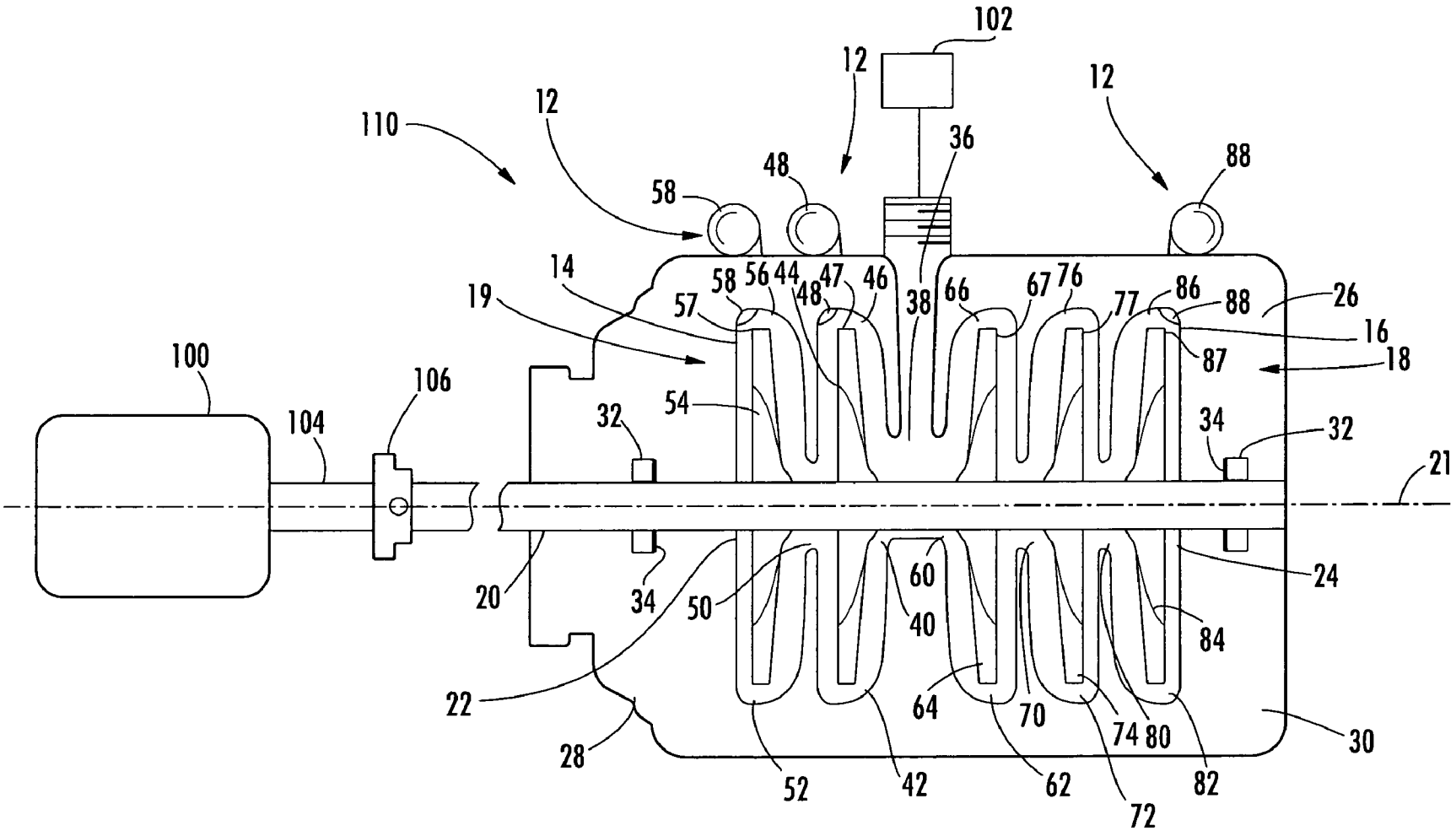
FIG. 2 is a partial cross-sectional schematic view of an alternative embodiment of a fluid pump having multiple outlets according to aspects of the present invention.

As shown in FIGS. 1 and 2, the invention is directed to a pump 10, 110 configured to receive at least one fluid, or fluid mixture, through an inlet 36 and direct those fluids through two or more fluid discharge outlets 12. In one embodiment, the fluid may be exhausted from the pump 10 (FIG. 1) 110 (FIG. 2) through a first fluid discharge outlet 78 (FIG. 1), 88 (FIG. 2) and a second fluid discharge outlet 58 (FIGS. 1 and 2) of the pump 10 (FIG. 1) 110 (FIG. 2). The fluid characteristics of the fluid exhausted through the first fluid discharge outlet 78, 88 may be different than the fluid characteristics of the fluid flowing through the second fluid discharge outlet 58.

For instance, in one embodiment, the fluid flowing from the first fluid discharge outlet 78, 88 may be at a first pressure that is greater than a pressure of the fluid exhausted from the second fluid discharge outlet 58. In other embodiments, other fluid characteristics, such as, but not limited to, flow rate, may be varied as well. The term "fluid characteristics" is defined as fluid pressure and fluid flow rate. For example, the first and second fluid discharge outlets 78, 88, 58 and other outlets may discharge fluids from the pump 10 (FIG. 1) 110 (FIG. 2) at the same pressure, but at different flow rates; at the same flow rates, but at different pressures; or at differing fluid pressures and flow rates.

In other embodiments, the pump 10, 110 may be configured to supply fluids through more than two fluid discharge outlets 12 at different fluid characteristics. Also, the first and second fluid discharge outlets 78, 88 and 58 may be positioned such that fluids at different pressures may be exhausted through the fluid discharge outlets 78, 88 and 58 without extracting fluids from the main pump flow. Rather, the fluids may be exhausted from the pump 10, 110 at the designed exhaust points 14, 16 for the pump 10, 110 at opposite ends 22, 24 of the pump 10,110. The pump 10, 110 may be formed from many different configurations. In one embodiment, the pump 10, 110 may be a centrifugal pump. However, in other embodiments, the pump 10, 110 may be formed of other forms of multistage pumps or other appropriate pumps.

As shown in FIGS. 1 and 2, the pump 10, 110 may be formed from a housing 28 including a plurality of pumping chambers 18, 19. In particular, the pump 10, 110 may include a first pumping chamber 18 and a second pumping chamber 19. In one embodiment, the first and second pumping chambers 18, 19 may be aligned along an axis 21. The first and second pumping chambers 18, 19 may be separated by a fluid inlet 36. The fluid inlet 36 may be in fluid communication with both the first and second pumping chambers 18, 19 to supply fluid to the chambers 18, 19. The first and second pumping chambers 18, 19 may be configured such that the first and second pumping chambers 18, 19 receive fluids from the fluid inlet 36 but extend away from each other along the axis 21. The first and second pumping chambers 18, 19 may be configured to exhaust fluids at different fluid characteristics. For instance, the first and second pumping chambers 18, 19 may be configured to exhaust fluids at different pressures from the pump 10, 110. For example, the first and second pumping chambers 18, 19 may be, but are not limited to circular impeller chambers, volute impeller chambers or any other casings sufficient to impart the desired pumping properties.

As shown in FIGS. 1 and 2, the pump 10, 110 may include a pump shaft 20 having a first end 22 and a second end 24. A motor 100, or other mechanical device, may be in communication with the shaft 20 to provide power to the pump shaft 20. The motor 100 may be driven by electricity, combustion, steam, or any other means sufficient to provide the pump shaft 20 with the appropriate amount of torque to the pump shaft 20 to operate. The pump shaft 20 may be positioned in the housing 28. The pump shaft 20 may be supported by one or more bearings 32 at each end with a seal 34. The pump shaft 20 can be connected to the output shaft 104 of the motor 100 by a coupling 106.

In one embodiment, the first and second pumping chambers 18, 19 may each be formed from one or more impeller chambers. For instance, as shown in FIG. 1, the first pumping chamber 18 may be formed from impeller chambers 62 and 72, and the second pumping chamber 19 may be formed from impeller chambers 42 and 52. In the embodiment shown in FIG. 2, the first pumping chamber 18 may be formed from impeller chambers 62, 72 and 82. In particular, the first pumping chamber 18 may include three impeller chambers 62, 72, and 82, and the second pumping chamber 19 may include two impeller chambers 42 and 52. Each impeller chamber 42, 52, 62, 72 and 82 may include one or more impellers 44, 54, 64, 74 and 84 for pumping a fluid. The impellers 44, 54, 64, 74 and 84 and impeller chambers 42, 52, 62, 72 and 82 may be configured to exhaust fluids through the first and second fluid discharge outlets 78, 88, and 58 at different fluid characteristics, as previously described.

As shown in FIG. 1, the fluid inlet 36 may be in fluid communication with a fluid source 102 and an inlet manifold 38 that can provide fluid communication to the inlet channels 40, 60. The fluid source 102 may be any source of fluid, such as for example, a reservoir or a similar device. One or more of the plurality of fluid discharge outlets 48, 58, 68, 78 may be in fluid communication with the fluid source 102 for re-circulation, if needed.

One or more fluids may flow from the fluid source 102, through the fluid inlet 36, through an inlet manifold 38 and into inlet channels 40 and 60 that feed the second and first pumping chambers 18, 19, respectively. The fluid inlet 36 and the inlet manifold 38 may be centrally located between the first and second pumping chambers 18, 19. Fluid may flow into the first pumping chamber 18 in a first direction toward a first end 24, and fluid may flow from the inlet manifold 36 to the second pumping chamber 19 in a generally opposite direction toward a second end 22 along the axis 21.

As shown in FIG. 1, the impeller chambers 42, 52, 62, 72 may receive fluid from the inlet channels 40, 50, 60, 70, respectively for pumping by the impellers 44, 54, 64, 74. Each impeller 44, 54, 64, 74 and associated impeller chamber 42, 52, 62, 72 may be configured to provide fluids to an associated fluid discharge outlet 48, 58, 68, 78, respectively. As the fluid is pumped by the impellers 44, 54, 64, 74, the fluid passes into and through a discharge channels 46, 56, 66, 76 in the impeller chambers 42, 52, 62, 72 repetitively through all of the stages formed by the impellers 44, 54, 64, 74. The discharge channels 46, 66 may be in fluid communication with fluid discharge outlets 48, 68 and inlet channels 50, 70, respectively. Fluid passing out of the discharge channels 46, 56, 66, 76 and through fluid discharge outlets 48, 58, 68, 78, can exit the pump 10 or be looped back into the pump 10 through a fluid loop 90, where the fluid is reintroduced into the fluid inlet 36 through the fluid loop 90. By way of example, the fluid loop 90 can be utilized to maintain desired pressures throughout the system, provide minimum flow through the pump during operation, and prevent overpressures that would otherwise result in damage to the pump or fluid system.

As shown in FIG. 1, the fluid discharge outlet 78 in communication with the first pumping chamber 18 may exhaust fluids at a higher pressure than fluids exhausted from the fluid discharge outlet 58 in communication with the second pumping chamber 19. In addition, the fluids exhausted from the fluid discharge outlets 48 and 68 may be at a lower pressure than fluids exhausted from the fluid discharge outlet 58. In such a configuration, the fluid discharge outlet 78 in communication with the first pumping chamber 18 may be a high pressure outlet, the fluid discharge outlet 58 in communication with the second pumping chamber 19 may be an intermediate pressure outlet, and the fluid discharge outlets 48 and 68 may be low pressure extraction outlets in communication with the second and first pumping chambers 19, 18, respectively. In such a configuration, the high pressure fluid outlet 78 may be positioned at the first end 24 of the pump 10 at the discharge channel 76, which is at the end of the first pumping channel 18. In addition, the intermediate pressure fluid outlet 58 may be positioned at the second end 22, opposite to the first end 24, at the discharge channel 56, which is at the end of the second pumping channel 19. Thus, the pump 10 may be configured to be a double ended pump for exhausting fluids at opposing ends of the pump 10 at different pressures or different flow rates, or both.

Fluid exiting the fluid discharge outlets 48, 58, 68, 78 may be regulated with control valves. For example, fluid flow can be regulated with a fluid flow valve and fluid pressure can be regulated with a pressure control valve. Pressure control valves may include, but are not limited to, rod and tube type pressure control valves, variable orifice pressure control valves and any other pressure control valves.

As shown in FIG. 2, the first and second pumping chambers 18, 19 of pump 110 may have different numbers of impellers and impeller chambers. In particular, the first pumping chamber 18 may include three impeller chambers 62, 72 and 82. However, the pump 110 is not limited to this number of impellers, but may have other numbers of impellers. The impeller chambers 62, 72, and 82 may include inlet channels 60, 70 and 80 and discharge channels 66, 76 and 86. The fluid discharge outlet 88 may be in fluid communication with the discharge channel 86 at the end of the first pumping chamber 18 that is opposite to the second pumping chamber 19. The fluid discharge outlet 88 in the first pumping chamber 18 may be a high pressure outlet, the fluid discharge outlet 58 in the second pumping chamber 19 may be an intermediate pressure outlet, and the fluid discharge outlet 48 in the second pumping chamber 19 may be a low pressure extraction outlet. The intermediate pressure outlet 58 may be positioned at the end of the second pumping chamber 19 and the low pressure extraction outlet 48 may be positioned between the intermediate pressure outlet 58 and the inlet 36.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A pump configured to discharge fluids through different outlets with different output characteristics, comprising:
- a pump housing having a fluid inlet in the pump housing for receiving a fluid for pumping;
- a first pumping chamber in fluid communication with the fluid inlet through a first inlet channel;
- a second pumping chamber in fluid communication with the fluid inlet through a second inlet channel;
- a first fluid discharge outlet in fluid communication with the first pumping chamber for discharging a fluid;
- a second fluid discharge outlet in fluid communication with the second pumping chamber for discharging a fluid;
- wherein the fluid discharged from the first fluid discharge outlet has different output characteristics than the fluid discharged from the second fluid discharge outlet; and
- a third fluid discharge outlet in which a fluid is discharged at a pressure lower than the pressure at which the fluid discharged from the second fluid discharge outlet, thereby forming a high pressure outlet at the first fluid discharge outlet, an intermediate pressure outlet at the second fluid discharge outlet, and a low pressure outlet at the third fluid discharge outlet;
- wherein the third fluid discharge outlet is coupled to the second pumping chamber and positioned between the intermediate pressure outlet and the inlet.

2. The pump of claim 1, wherein the first pumping chamber and the second pumping chamber are aligned axially and separated by the fluid inlet thereby positioning the first pumping chamber at a first end and the second pumping chamber at a second end opposite to the first end.

3. The pump of claim 1, wherein the first pumping chamber is a first impeller chamber including at least one impeller, and the second pumping chamber is a second impeller chamber including at least one impeller.

4. The pump of claim 3, wherein the at least one impeller in the first pumping chamber and the at least one impeller in the second pumping chamber are operatively connected to a shaft that is coupled to a motor.

5. A pump configured to discharge fluids through different outlets with different output characteristics, comprising:
- a pump housing having a fluid inlet in the pump housing for receiving a fluid for pumping;
- a first pumping chamber in fluid communication with the fluid inlet through a first inlet channel;
- a second pumping chamber in fluid communication with the fluid inlet through a second inlet channel;
- a first fluid discharge outlet in fluid communication with the first pumping chamber for discharging a fluid;
- a second fluid discharge outlet in fluid communication with the second pumping chamber for discharging a fluid;
- wherein the fluid discharged from the first fluid discharge outlet has a higher pressure than a pressure of the fluid discharged from the second fluid discharge outlet; and
- a third fluid discharge outlet in which a fluid is discharged at a pressure lower than the pressure at which the fluid discharged from the second fluid discharge outlet, thereby forming a high pressure outlet at the first fluid discharge outlet, an intermediate pressure outlet at the second fluid discharge outlet, and a low pressure outlet at the third fluid discharge outlet;
- wherein the third fluid discharge outlet is coupled to the second pumping chamber and positioned between the intermediate pressure outlet and the inlet;
- wherein the first pumping chamber is a first impeller chamber including at least one impeller, and the second pumping chamber is a second impeller chamber including at least one impeller.

6. The pump of claim 5, wherein the first pumping chamber and the second pumping chamber are aligned axially and separated by the fluid inlet.

7. The pump of claim 5, wherein the at least one impeller in the first pumping chamber and the at least one impeller in the second pumping chamber are operatively connected to a shaft that is coupled to a motor.

8. A pump configured to discharge fluids through different outlets with different output characteristics, comprising:
- a pump housing having a fluid inlet in the pump housing for receiving a fluid for pumping;
- a first pumping chamber in fluid communication with the fluid inlet through a first inlet channel;
- a second pumping chamber in fluid communication with the fluid inlet through a second inlet channel;
- a first fluid discharge outlet in fluid communication with the first pumping chamber for discharging a fluid;
- a second fluid discharge outlet in fluid communication with the second pumping chamber for discharging a fluid;
- wherein the fluid discharged from the first fluid discharge outlet has a higher pressure than a pressure of the fluid discharged from the second fluid discharge outlet;
- a third fluid discharge outlet in which a fluid is discharged at a pressure lower than the pressure at which the fluid is discharged from the second fluid discharge outlet, thereby forming a high pressure outlet at the first fluid discharge outlet, an intermediate pressure outlet at the second fluid discharge outlet, and a low pressure outlet at the third fluid discharge outlet;

wherein the third fluid discharge outlet is coupled to the second pumping chamber and positioned between the intermediate pressure outlet and the inlet;

a fourth fluid discharge outlet that forms another low pressure outlet and is coupled to the first pumping chamber between the high pressure outlet and the inlet; and wherein the first pumping chamber and the second pumping chamber are aligned axially and separated by the fluid inlet.

9. The pump of claim 8, wherein the first pumping chamber is a first impeller chamber including at least one impeller, and the second pumping chamber is a second impeller chamber including at least one impeller.

10. The pump of claim 9, wherein the at least one impeller in the first pumping chamber and the at least one impeller in the second pumping chamber are operatively connected to a shaft that is coupled to a motor.

* * * * *